US006400825B1

(12) United States Patent
Miyamoto et al.

(10) Patent No.: US 6,400,825 B1
(45) Date of Patent: Jun. 4, 2002

(54) MICROSPEAKER

(75) Inventors: Kazumi Miyamoto; Takashi Kobayashi; Yoshizumi Ohta, all of Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 09/970,890

(22) Filed: Oct. 5, 2001

(51) Int. Cl.[7] ..... H04R 25/00

(52) U.S. Cl. ..... 381/409; 381/396; 381/189; 381/394; 340/391.1

(58) Field of Search ..... 381/396, 398, 381/400, 409, 410, FOR 152, FOR 154, 391, 394, 393, 189; 340/384.1, 391.1

(56) References Cited

U.S. PATENT DOCUMENTS

| | | | | | |
|---|---|---|---|---|---|
| 4,315,112 | A | * | 2/1982 | Hofer | 381/409 |
| 4,376,233 | A | * | 3/1983 | Kamon et al. | 381/409 |
| 5,394,479 | A | * | 2/1995 | Ishigaya et al. | 381/394 |
| 6,208,238 | B1 | * | 3/2001 | Ohta | 381/396 |
| 6,265,965 | B1 | * | 7/2001 | Lee | 381/398 |

* cited by examiner

*Primary Examiner*—Huyen Le
(74) *Attorney, Agent, or Firm*—Dennison, Schultz & Dougherty

(57) ABSTRACT

A microspeaker has a case, a vibrating plate, a voice coil secured to the vibrating plate. A pair of leads are embedded in one of members made of plastic. Both end portions of each of the leads are projected from the case. Each of both ends of the voice coil is secured to one of the projected end portions of each of the leads. Both the projected end portions of each of the leads are bent along a periphery of the case.

6 Claims, 9 Drawing Sheets

MICROSPEAKER

BACKGROUND OF THE INVENTION

The present invention relates to a microphone used in a portable communication equipment such as a portable telephone and other equipments.

Referring to FIGS. 16 and 17 showing a conventional microspeaker, a yoke 2 made of magnetic material is embedded in a case 1 made of plastic by insert molding. A permanent magnet 3 is secured to the yoke 2, and a top plate 4 made of magnetic material is adhered to the magnet 3 to form a magnetic circuit and to form a magnetic gap between the top plate 4 and the yoke 2.

A vibrating plate 6 is secured to the case 1 at the periphery thereof. A voice coil 5 secured to the underside of the vibrating plate 6 is inserted in the magnetic gap. A protector 7 made of metal is secured to the case 1, interposing the vibrating plate 6. A plurality of sound discharge holes are formed in the case 1 and the protector 7.

A pair of ends 9 of the voice coil 5 are adhered to the underside of the vibrating plate 6 as shown in FIG. 16. Each of the ends 9 is outwardly extended from the case 1 passing through a groove formed in a peripheral wall of the case. On the underside of the case 1, a substrate 8 made of plastic is adhered, and a pair of terminal plates 10 are secured to the substrate 8. Each of the terminal plate has a V-shape and each end 9 is connected to one of the branches of the terminal plate 10 by solder 11. The other branch of the terminal plate 10 is used for connecting the end 9 to a circuit of the equipment to be mounted therein.

Thus, when a signal current is applied to the voice coil 5 through the terminal plates 10, the vibrating plate 6 vibrates to produce sounds.

In the conventional speaker, the substrate 8 is adhered and ends 9 of the voice coil are soldered to the terminal plates 10. Consequently, an assembling operation of the speaker is complicated.

SUMMARY OF THE INVENTION

An object of the present invention is to provide a microspeaker which may be assembled without substrate and the soldering operation, thereby reducing the number of parts and assembling steps.

According to the present invention, there is provided a microspeaker comprising a case, a yoke made of magnetic material, a permanent magnet provided in the case, a vibrating plate, a voice coil, a protector plate, the yoke, vibrating plate and protector plate being secured to the case, a pair of leads embedded in one of members made of plastic, both end portions of each of the leads being projected from the case, each of both ends of the voice coil being secured to one of the projected end portions of each of the leads, and both the projected end portions of each of the leads being bent along a periphery of the case.

Each of the leads has an arcuated shape.

In an aspect of the present invention, the leads are embedded in the case.

In another aspect of the present invention, the leads are embedded in the protector plate.

The case may comprise an upper case and a lower case, and the leads are embedded in the upper case, and the vibrating plate is secured to the upper case.

These and other objects and features of the present invention will become more apparent from the following detailed description with reference to the accompanying drawings.

DETAILED DESCRIPTION OF THE PREFERRED EMBODIMENT

Figure 1:
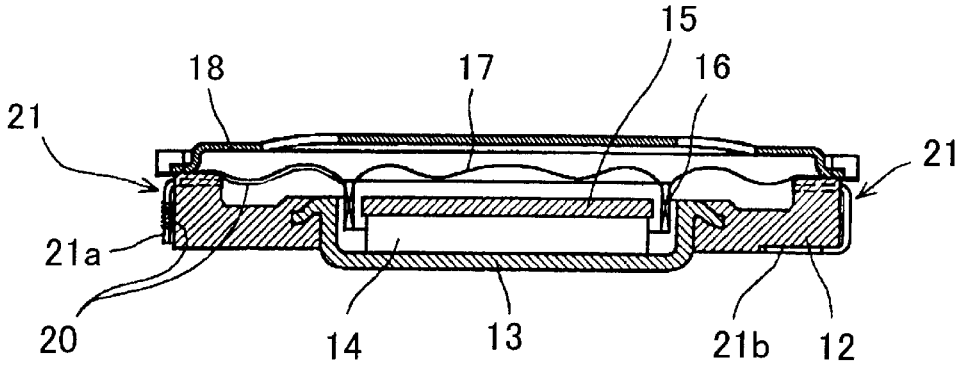
FIG. 1 is a sectional view of a first embodiment of a microspeaker of the present invention.
Figure 2:
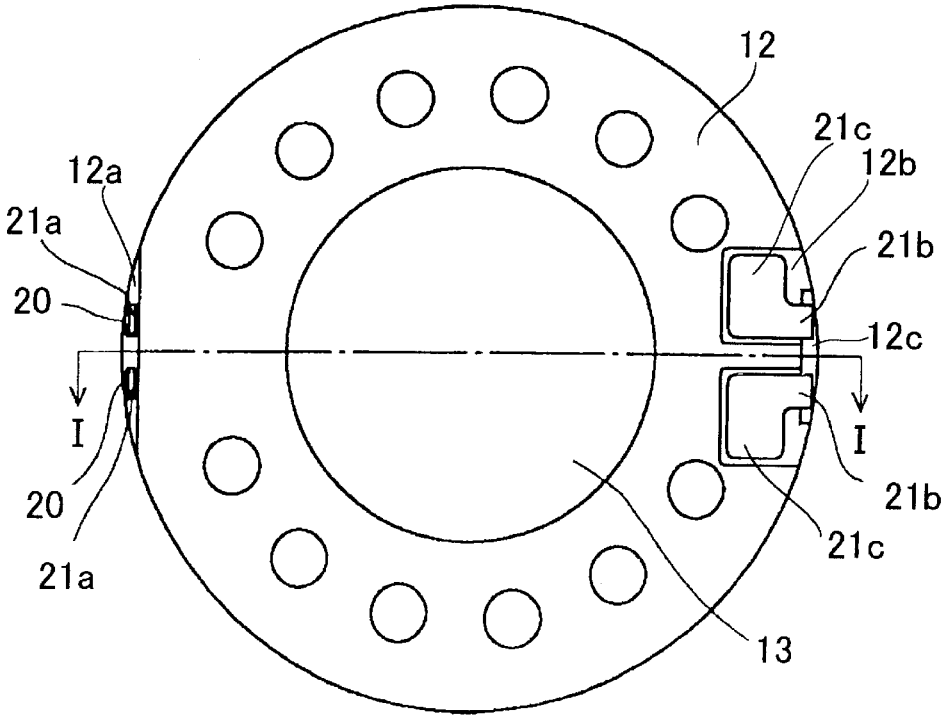
FIG. 2 shows an underside of the microspeaker of FIG. 1.

Referring to FIGS. 1 and 2, the microspeaker of the first embodiment of the present invention comprises a yoke 13 made of magnetic material and embedded in a case 12 by insert molding, a permanent magnet 14 secured to the yoke 13, and a top plate 15 adhered to the magnet 14.

A vibrating plate 17 is secured to the case 12 at the periphery thereof. A voice coil 16 secured to the underside of the vibrating plate 17 is inserted in the magnetic gap between the top plate 15 and the yoke 13. A protector plate 18 made of metal is secured to the case 12, interposing the vibrating plate 17. A plurality of sound discharge holes are formed in the case 12 and the protector plate 18.

A pair of arcuated leads 21 made of metal are symmetrically disposed and embedded in the case 12 by insert molding. An end 21*a* of each of the leads 21 is elongated and bent toward a recess 12*a* formed in the peripheral wall of the case 12. The other end 21*b* is further elongated and bent in a recess 12*b* of the underside of the case 12 through a periphery recess 12*c*. The endmost portion is enlarged to form a terminal portion 21*c*.

A pair of ends 20 of the voice coil 16 are adhered to the underside of the vibrating plate 17. Each of the ends 20 is outwardly extended from the case 12 passing through a groove formed in a peripheral wall of the case, and wound on the end 21*a* of the lead 21 and fixed thereto by soldering or welding. The terminal portion 21*c* is contacted with a terminal of an equipment in which the microspeaker is mounted.

Figure 3:
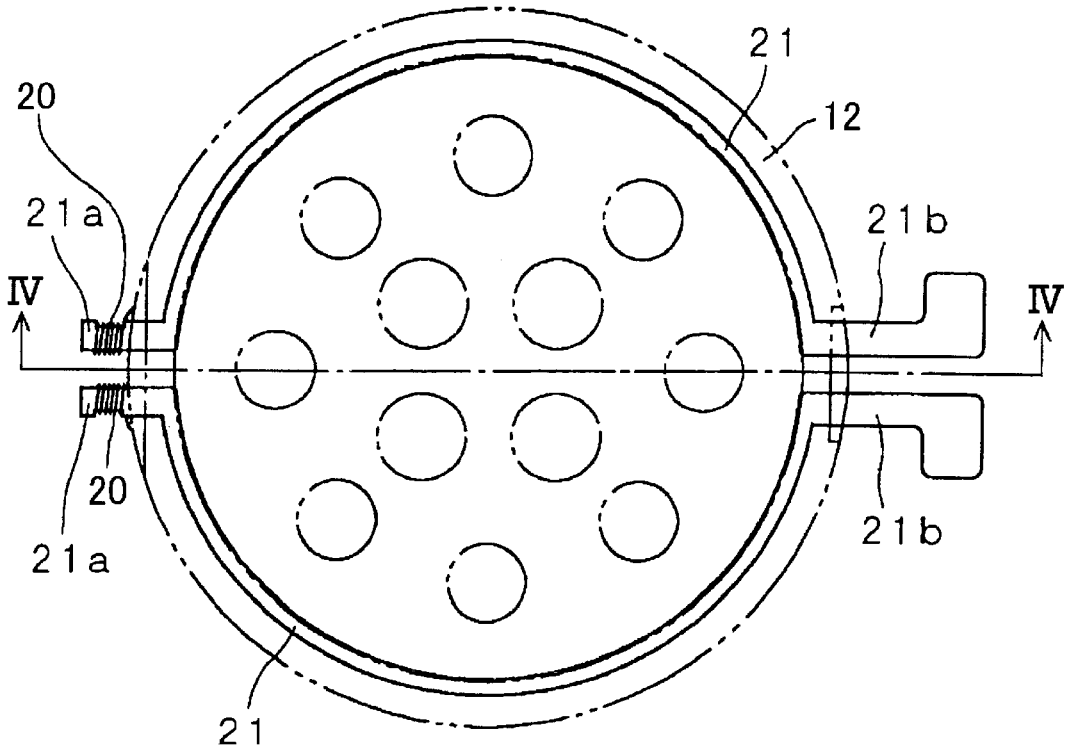
FIG. 3 is a plan view for explaining manufacturing operation of the microspeaker.
Figure 4:
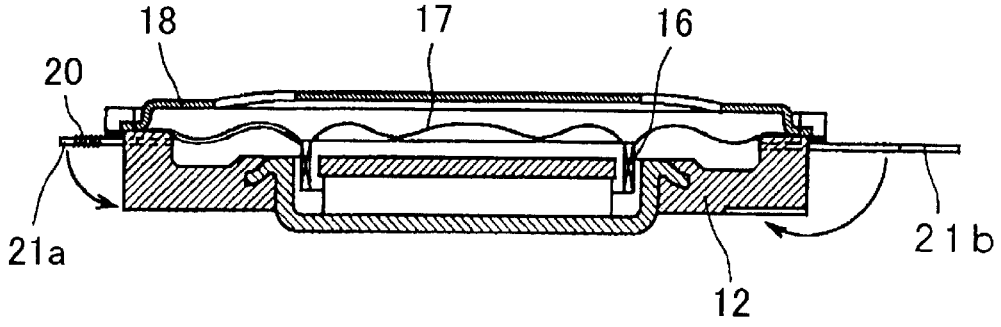
FIG. 4 is a sectional view taken along a line IV—IV of FIG. 3.

FIGS. 3 and 4 show conditions of the leads 21 before bending. The end 20 is wound on the end 21*a* and fixed thereto by soldering or welding. Ends 21*a* and 21*b* are bent as shown by arrows in FIG. 4.

Figure 5:
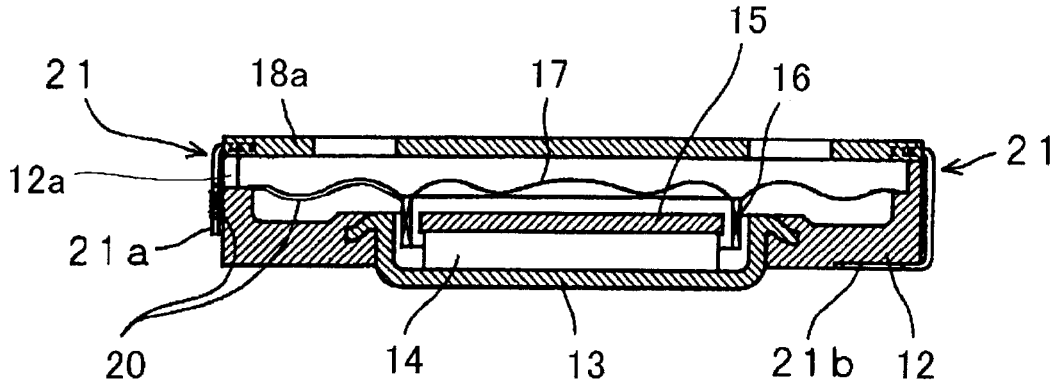
FIG. 5 is a sectional view of a second embodiment of the present invention.
Figure 6:
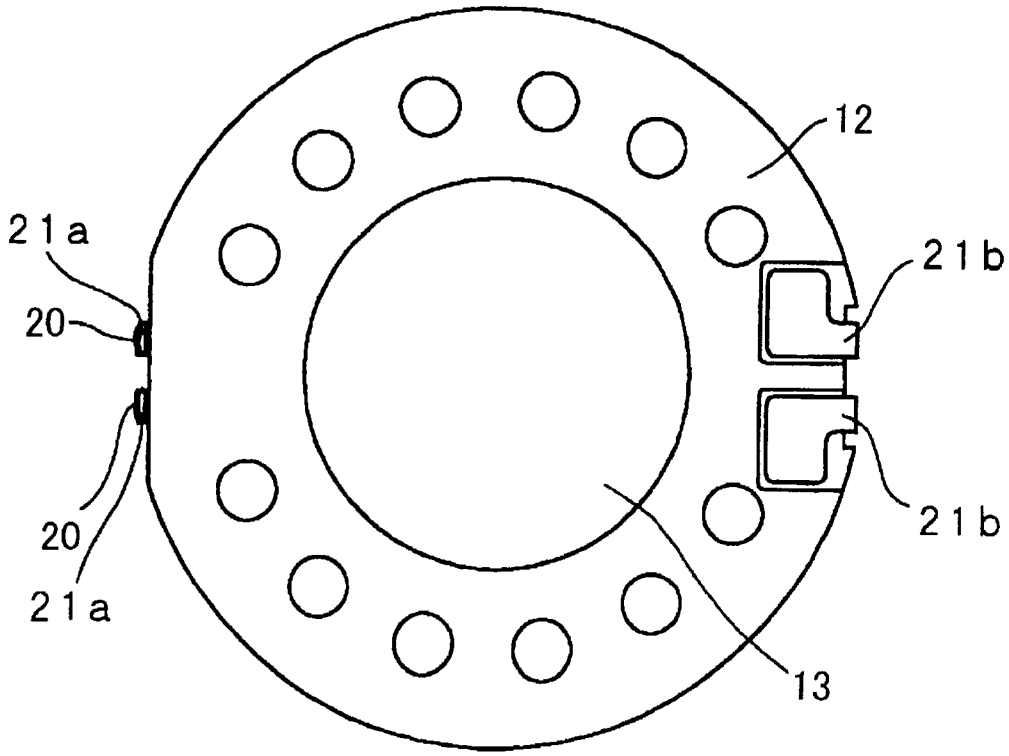
FIG. 6 shows an underside of the microspeaker of FIG. 5.
Figure 7:
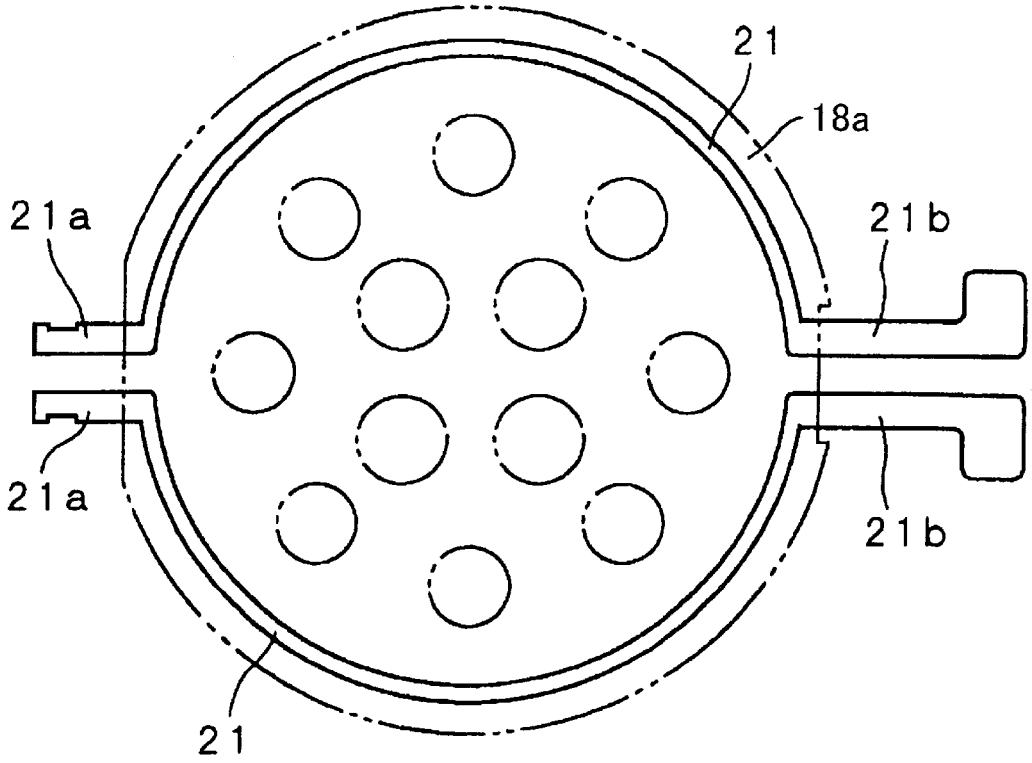
FIGS. 7, 8 and 9 are plan view and sectional views for explaining manufacturing operation of the microspeaker.

FIGS. 5 and 6 show the second embodiment of the present invention, and the same portions as the first embodiment are identified by the same reference numerals as the first embodiment.

Figure 8:
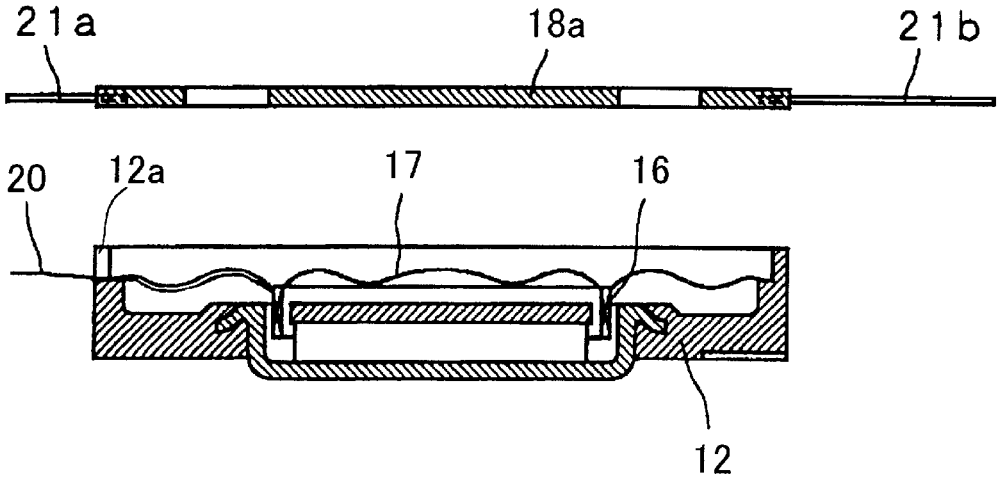

A protector plate 18*a* is made of plastic and the leads 21 are embedded in the protector as shown in FIG. 8. The case 12 has a groove 12*a*. The ends 20 of the voice coil 16 are projected from the groove 12*a* as shown in FIG. 8.

Figure 9:
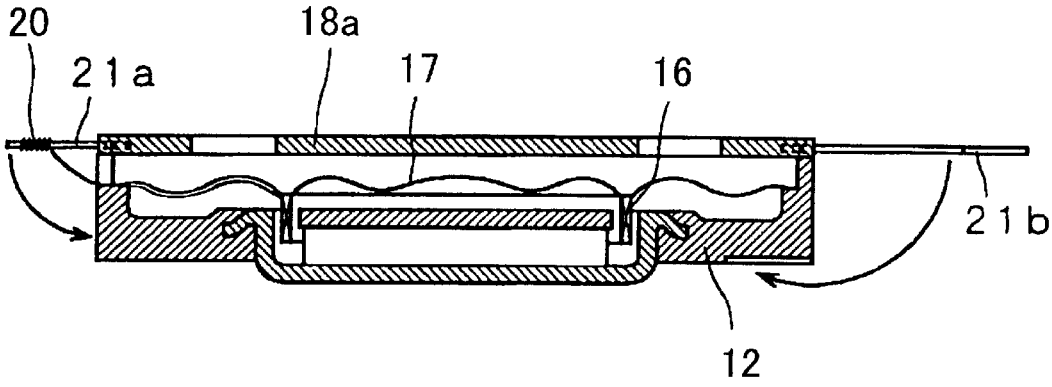

The protector plate 18*a* is adhered to the case 12 and the ends 20 are fixed to the ends 21*a* as shown in FIG. 9. Next, the ends 21*a* and 21*b* are bent as shown by arrows in FIG. 9, so that the microspeaker is assembled as shown in FIGS. 5 and 6.

Figure 10:
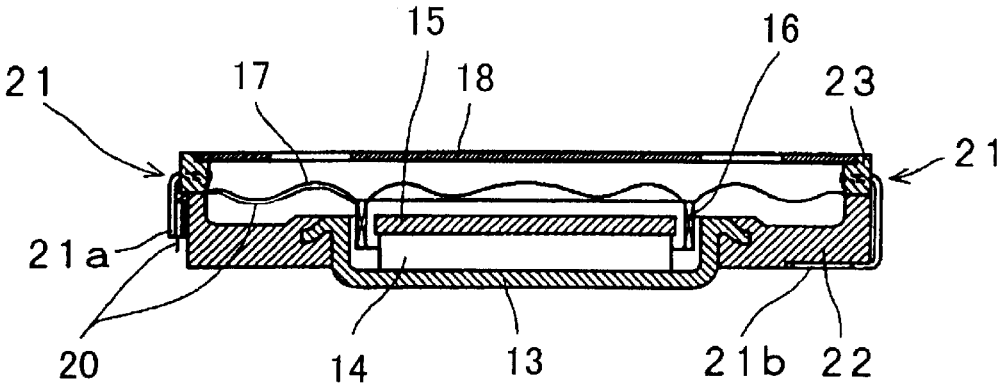
FIG. 10 is a sectional view of a third embodiment of the present invention.
Figure 11:
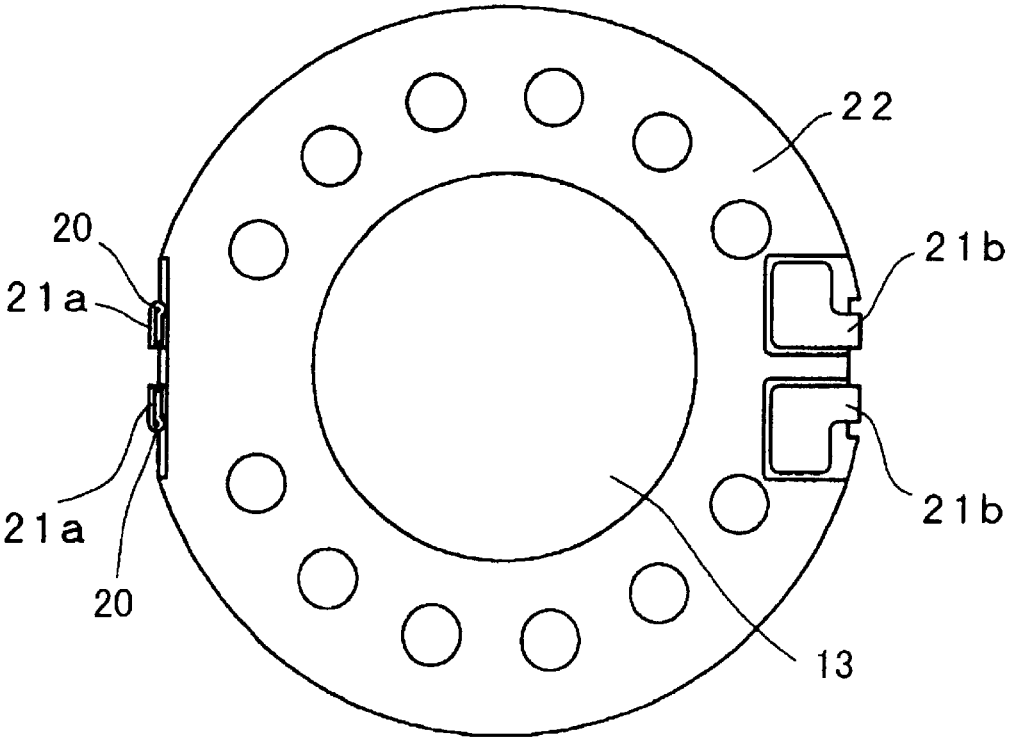
FIG. 11 shows an underside of the microspeaker of FIG. 10.

FIGS. 10 and 11 show the third embodiment of the present invention. In the speaker, the case is divided into a lower case 22 and an upper case 23. The leads 21 are embedded in the upper case 23.

Figure 12:
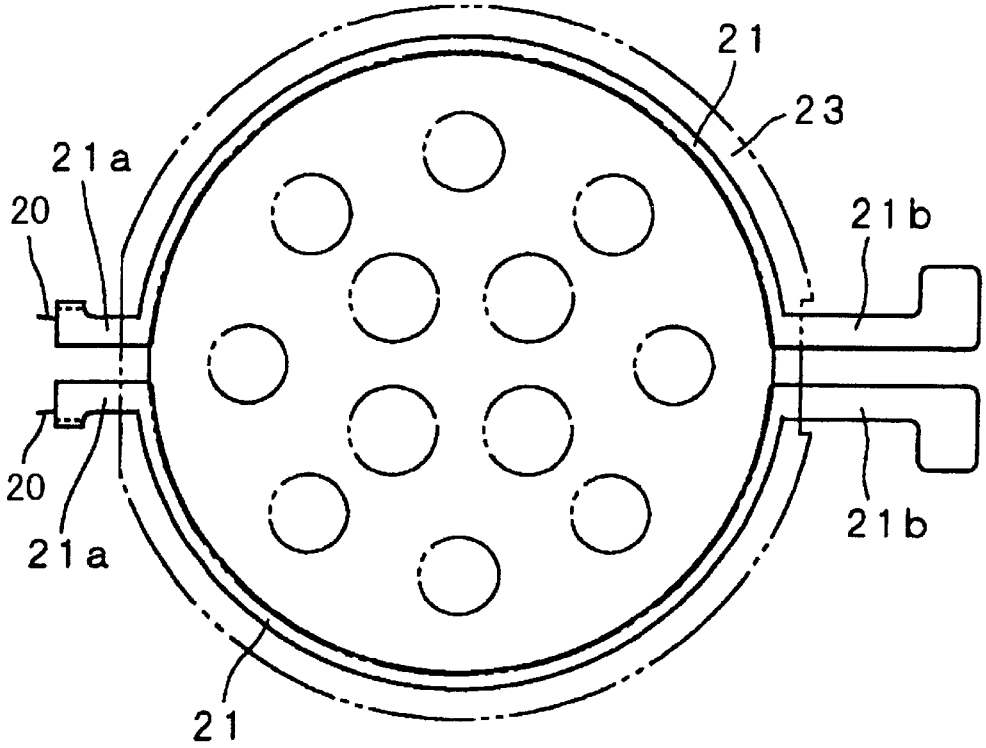
FIGS. 12, 13, 14*a*–14*c* and 15 show manufacturing operation.
Figure 13:
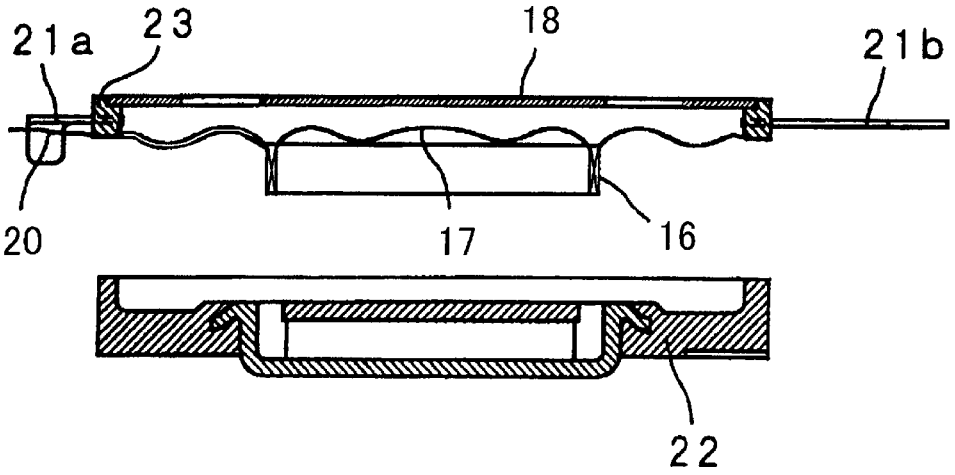

FIGS. 12 and 13 show the microspeaker before the assembling thereof. The vibrating plate 17 is fixed to the upper case 23 and the voice coil 16 is secured to the vibrating plate 17. The vibrating plate 17 may be fixed to the case through a fixing plate, and the leads may be fixed to the fixing plate.

In the first and second embodiments, the voice coil 16 must be secured to the vibrating plate 17 before the vibrating plate 17 is fixed to the case. In the third embodiment, the voice coil 16 may be secured to the vibrating plate 17 after the vibrating plate is fixed to the upper case 23. Therefore, the assembling operation can be easily performed since the vibrating plate 17 is enforced by the upper case 23. Furthermore, since either of the leads 21 and the vibrating plate 17 are secured to the upper case 23, the positioning of the voice coil 16 and the ends 20 can be easily carried out.

Figure 14A:
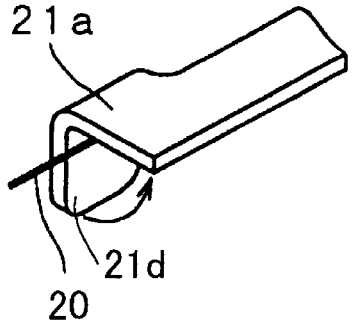
Figure 14B:
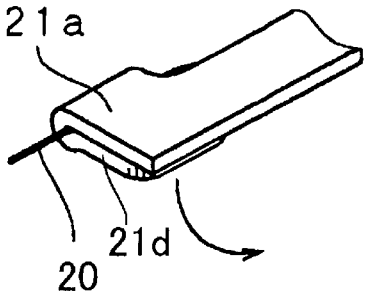
Figure 14C:
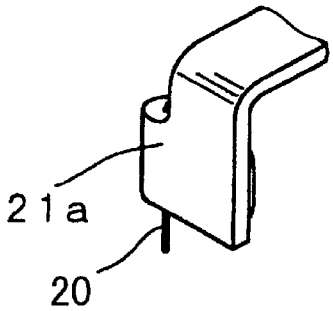

As shown in FIG. 14*a*, an end portion 21*d* of the lead 21 is downwardly bent and the end 20 of the voice coil 16 is put to the corner of the end portion 21*d*, and the end 20 is soldered to the end portion 21*d*. Then, the end portion 21*d* is further bent as shown in FIG. 14*b*. Since the vibrating plate 17 is enforced as described above, the securing operation of the voice coil 16 and the end portion 21*d* can be performed by automatic operation.

Figure 15:
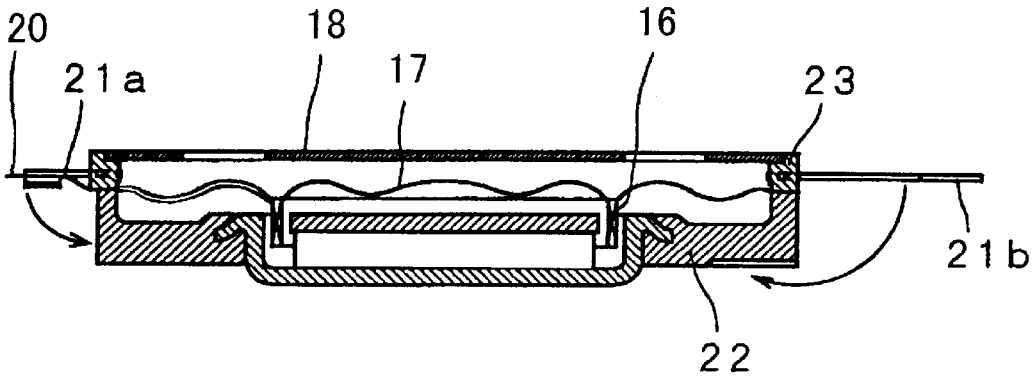
Figure 16:
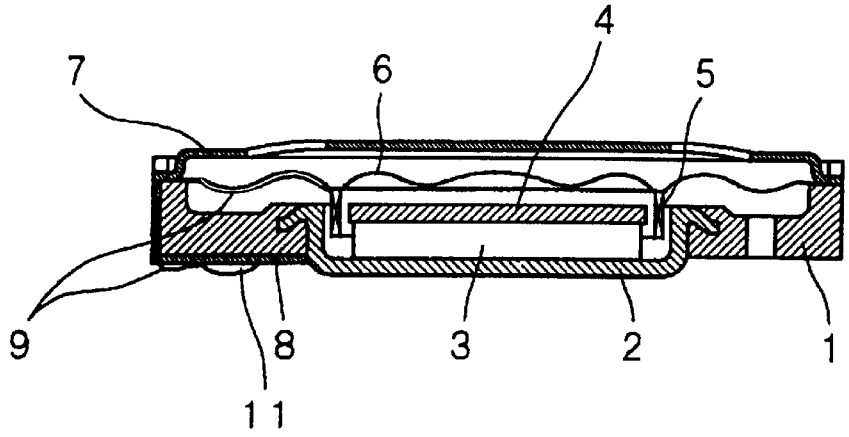
FIG. 16 PRIOR ART
FIG. 16 is a sectional view of a conventional microspeaker.
Figure 17:
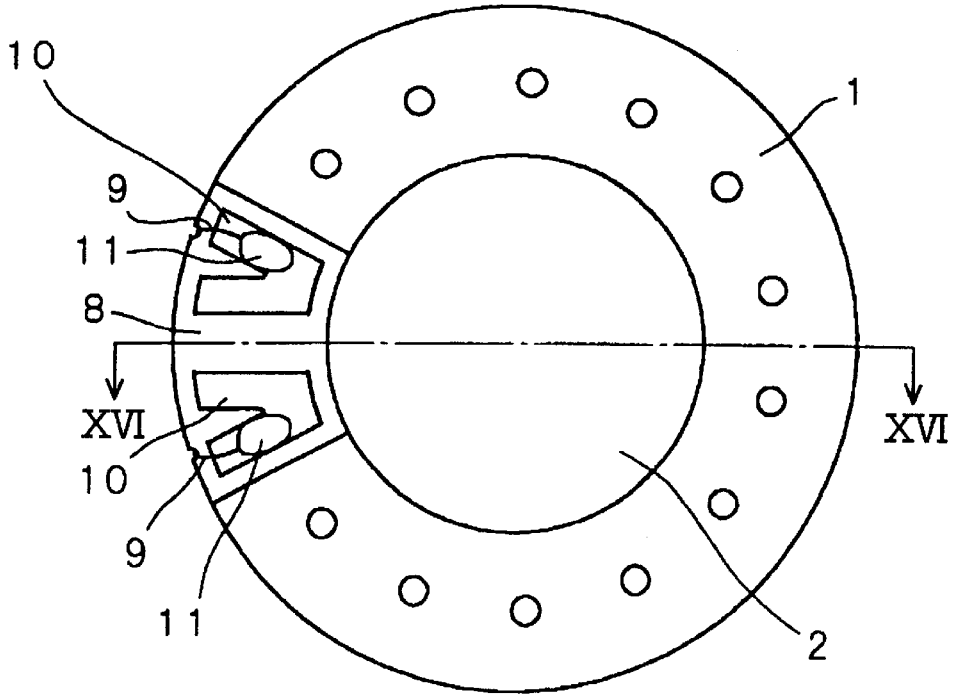
FIG. 17 PRIOR ART
FIG. 17 shows an underside of the microspeaker of FIG. 16.

Thus assembled upper case 23 is adhered to the lower case as shown in FIG. 15, and the ends 21*a* and 21*b* are bent as shown by arrows.

In accordance with the present invention, it is unnecessary to adhere a substrate to the case unlike the conventional microspeaker. Consequently, the number of parts of the speaker is reduced, and the assembling operation is simplified.

While the invention has been described in conjunction with preferred specific embodiment thereof, it will be understood that this description is intended to illustrate and not limit the scope of the invention, which is defined by the following claims.

What is claimed is:

1. A microspeaker comprising:

a case;

a yoke made of magnetic material;

a permanent magnet provided in the case;

a vibrating plate;

a voice coil;

a protector plate;

the yoke, vibrating plate and protector plate being secured to the case;

a pair of leads embedded in one of members made of plastic;

both end portions of each of the leads being projected from the case;

each of both ends of the voice coil being secured to one of the projected end portions of each of the leads; and both the projected end portions of each of the leads being bent along a periphery of the case.

2. The microspeaker according to claim 1 wherein each of the leads has an arcuated shape.

3. The microspeaker according to claim 1 wherein the leads are embedded in the case.

4. The microspeaker according to claim 1 wherein the leads are embedded in the protector plate.

5. The microspeaker according to claim 1 wherein the case comprises an upper case and a lower case, and the leads are embedded in the upper case.

6. The microspeaker according to claim 5 wherein the vibrating plate is secured to the upper case.

* * * * *